US012339076B2

(12) United States Patent
Taras et al.

(10) Patent No.: US 12,339,076 B2
(45) Date of Patent: Jun. 24, 2025

(54) HEAT EXCHANGER ASSEMBLY AND METHOD FOR HVAC SYSTEM

(71) Applicant: Goodman Manufacturing Company, L.P., Waller, TX (US)

(72) Inventors: Michael F. Taras, Spring, TX (US); Auston Green, Cypress, TX (US); Anal Prakhar Sharma, Houston, TX (US)

(73) Assignee: Goodman Manufacturing Company, L.P., Waller, TX (US)

( * ) Notice: Subject to any disclaimer, the term of this patent is extended or adjusted under 35 U.S.C. 154(b) by 208 days.

(21) Appl. No.: 17/561,520

(22) Filed: Dec. 23, 2021

(65) Prior Publication Data

US 2023/0204297 A1 Jun. 29, 2023

(51) Int. Cl.
*F28F 9/02* (2006.01)
*F28D 1/053* (2006.01)

(52) U.S. Cl.
CPC ..... *F28F 9/0209* (2013.01); *F28D 1/05325* (2013.01); *F28F 2260/02* (2013.01); *F28F 2270/02* (2013.01)

(58) Field of Classification Search
CPC .... F28F 9/0209; F28F 9/0212; F28F 2270/02; F28D 1/05375
See application file for complete search history.

(56) References Cited

U.S. PATENT DOCUMENTS 8,561,680 B2 10/2013 Jiang et al.
8,826,971 B2 9/2014 Xiangxun et al.
9,115,939 B2 8/2015 Huazhao et al.
10,948,208 B2 3/2021 Oka et al.
2003/0209344 A1 11/2003 Fang et al.
(Continued)

FOREIGN PATENT DOCUMENTS

FR 3049050 A1 * 9/2017
JP H06273088 A * 3/1993

OTHER PUBLICATIONS

Huang et al., "A Simulation Study on Two-Phase Microchannel Evaporator Header Distribution Using Computational Fluid Dynamics Header Model and Segmented Heat Transfer Tube Model," Paper, 17th International Refrigeration and Air Conditioning Conference at Purdue, Jul. 9-12, 2018 (11 pages).
(Continued)

*Primary Examiner* — Eric S Ruppert
(74) *Attorney, Agent, or Firm* — Eubanks PLLC

(57) ABSTRACT

An HVAC heat exchanger with an array of tubes including one or more dead tubes is provided. In one embodiment, the heat exchanger is a microchannel heat exchanger operable to exchange heat with air in an HVAC system via refrigerant passing through the microchannel heat exchanger. The microchannel heat exchanger includes an array of flat tubes arranged between a first manifold and a second manifold. The array of flat tubes includes multiple tubes coupled in fluid communication with the first manifold and the second manifold to convey refrigerant between the first manifold and the second manifold through microchannels of the multiple tubes. The array of flat tubes also includes one or more dead tubes that do not convey refrigerant between the first manifold and the second manifold. Additional systems, devices, and methods are also disclosed.

26 Claims, 10 Drawing Sheets

(56) References Cited

U.S. PATENT DOCUMENTS

| | | | | |
|---|---|---|---|---|
| 2007/0246206 | A1 | 10/2007 | Gong et al. | |
| 2011/0056668 | A1 | 3/2011 | Taras et al. | |
| 2012/0261104 | A1 | 10/2012 | Kelly et al. | |
| 2013/0283585 | A1 | 10/2013 | Desireddy et al. | |
| 2015/0168072 | A1* | 6/2015 | Ueno | F24F 1/0067 165/144 |
| 2017/0328637 | A1* | 11/2017 | Parola | F28D 1/0443 |
| 2018/0120001 | A1* | 5/2018 | Byers | F28D 1/05391 |
| 2019/0226692 | A1 | 7/2019 | Yamada et al. | |

OTHER PUBLICATIONS

"Microchannel Heat Exchangers," Brochure, Daikin Applied, dated 2018 (1 page).

"MicroChannel Heat Exchangers Installation and Maintenance Guide," Service Guide, Danfoss MicroChannel Heat Exchangers (Jia Xing) Co., Ltd., dated Jan. 2019 (10 pages).

* cited by examiner

HEAT EXCHANGER ASSEMBLY AND METHOD FOR HVAC SYSTEM

BACKGROUND

This section is intended to introduce the reader to various aspects of art that may be related to various aspects of the presently described embodiments. This discussion is believed to be helpful in providing the reader with background information to facilitate a better understanding of the various aspects of the present embodiments. Accordingly, it should be understood that these statements are to be read in this light, and not as admissions of prior art.

Modern residential and industrial customers expect indoor spaces to be climate controlled. In general, heating, ventilation, and air conditioning ("HVAC") systems circulate an indoor space's air over low-temperature (for cooling) or high-temperature (for heating) sources, thereby adjusting the indoor space's ambient air temperature. HVAC systems generate these low- and high-temperature sources by, among other techniques, taking advantage of a well-known physical principle: a fluid transitioning from gas to liquid releases heat, while a fluid transitioning from liquid to gas absorbs heat. Within a typical HVAC system, a fluid refrigerant circulates through a closed loop of tubing that uses a compressor and other flow-control devices to manipulate the refrigerant's flow and pressure, causing the refrigerant to cycle between the liquid and gas phases. Generally, these phase transitions occur within the HVAC's heat exchangers, which are part of the closed loop and designed to transfer heat between the circulating refrigerant and flowing ambient air.

In some instances, a HVAC system is a split system having indoor and outdoor units, each having a heat exchanger, connected in fluid communication. As would be expected in such cases, the heat exchanger providing heating or cooling to the climate-controlled space or structure is described adjectivally as being "indoors," and the heat exchanger transferring heat with the surrounding outdoor environment is described as being "outdoors." The refrigerant circulating between the indoor and outdoor heat exchangers—transitioning between phases along the way—absorbs heat from one location and releases it to the other. Those in the HVAC industry describe this cycle of absorbing and releasing heat as "pumping." To cool the climate-controlled indoor space, heat is "pumped" from the indoor side to the outdoor side. And the indoor space is heated by doing the opposite, pumping heat from the outdoors to the indoors.

In some other instances, a packaged HVAC system is a self-contained unit including two heat exchangers (e.g., an evaporator coil and a condenser coil), a blower, a compressor, and a refrigerant circuit installed in a shared cabinet. A packaged HVAC system can be installed at any suitable location but is often installed outside, such as on the ground or on the roof of a building. Heated or cooled air is provided from the packaged HVAC system to the indoor space of a building, such as through a supply duct, and air is drawn from the indoor space to the packaged HVAC system, such as through a return duct.

SUMMARY

Certain aspects of some embodiments disclosed herein are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

Certain embodiments of the present disclosure generally relate to heat exchangers for HVAC systems. More specifically, some embodiments relate to a microchannel heat exchanger having an array of tubes arranged between a first manifold and a second manifold. Refrigerant may be routed between the first and second manifolds via tubes of the array. But in at least some instances, the array of tubes includes at least one "dead" tube that is not in fluid communication with the first and second manifold and does not convey the refrigerant between these manifolds. In the case of a multi-pass heat exchanger, so-called dead tubes may be provided in the array to reduce thermal cross-conduction between tubes of two different passes. Dead tubes may also or instead be provided in the array to reduce corrosion and increase reliability of the heat exchanger. Still further, dead tubes may also or instead be provided in the array to reduce thermal stress in the heat exchanger. If the dead tubes are positioned at the microchannel heat exchanger ends, they provide mechanical protection to the live tubes caring refrigerant. Therefore, the dead tubes are strategically positioned within the microchannel heat exchanger array. The heat exchangers may be installed in a packaged system, a split system, or any other suitable HVAC system.

Various refinements of the features noted above may exist in relation to various aspects of the present embodiments. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of some embodiments without limitation to the claimed subject matter.

BRIEF DESCRIPTION OF THE DRAWINGS

These and other features, aspects, and advantages of certain embodiments will become better understood when the following detailed description is read with reference to the accompanying drawings in which like characters represent like parts throughout the drawings, wherein.

DETAILED DESCRIPTION OF SPECIFIC EMBODIMENTS

Specific embodiments of the present disclosure are described below. In an effort to provide a concise description of these embodiments, all features of an actual implementation may not be described. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time-consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements.

As noted above, some embodiments of the present disclosure relate to heat exchangers with an array of tubes in which some of the tubes convey refrigerant but one or more of the tubes are dead tubes that do not convey refrigerant. In some instances, such a heat exchanger is a microchannel heat exchanger having microchannels in the tubes for conveying refrigerant. The heat exchanger can be installed in a split system, a packaged system, or some other HVAC system.

Figure 1:
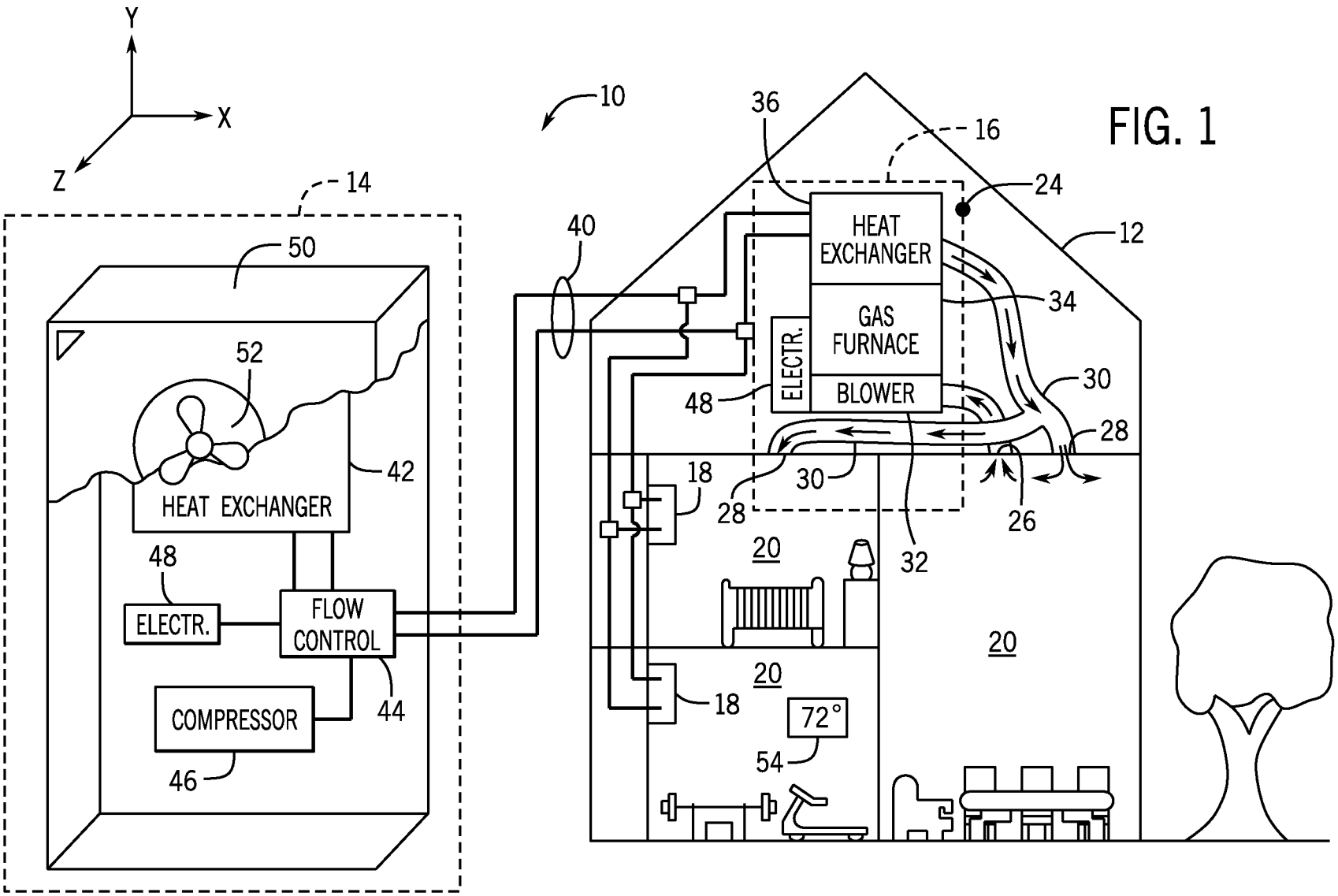
FIG. 1 illustrates schematically an HVAC system for heating and cooling indoor spaces within a structure, in accordance with one embodiment of the present disclosure.

By way of example, and turning now the figures, FIG. 1 illustrates a split HVAC system 10 in accordance with one embodiment. As depicted, the system 10 provides heating and cooling for a residential structure 12. But the concepts disclosed herein are applicable to a myriad of heating and cooling situations, including industrial and commercial settings. And while some HVAC systems provide each of heating, ventilation, and air conditioning, others do not. The term "HVAC system," as used herein, means a system that provides one or more of heating, ventilation, air conditioning, or refrigeration. For example, an air conditioner that does not provide heating or ventilation is considered an HVAC system. The use of the term "HVAC" in describing a system, unit, component, equipment, etc., herein is not to be interpreted as a requirement that each of heating, ventilation, and air conditioning is provided.

Many North American residences employ "ducted" systems, in which a structure's ambient air is circulated over a central indoor heat exchanger and then routed back through relatively large ducts (or ductwork) to multiple climate-controlled indoor spaces. However, the use of a central heat exchanger can limit the ducted system's ability to vary the temperature of the multiple indoor spaces to meet different occupants' needs. This is often resolved by increasing the number of separate systems within the structure—with each system having its own outdoor unit that takes up space on the structure's property, which may not be available or at a premium.

Residences outside of North America often employ "duchess" systems, in which refrigerant is circulated between an outdoor unit and one or more indoor units to heat and cool specific indoor spaces. Unlike ducted systems, duchess systems route conditioned air to the indoor space directly from the indoor unit—without ductwork. Typically, duchess systems are suited for moderate climates, and are not optimal for climates where robust heating of the indoor space may be desired.

The described HVAC system 10 of FIG. 1 is a split system with two primary portions: the outdoor unit 14, which mainly comprises components for transferring heat with the environment outside the structure 12; and the indoor units 16 & 18, which mainly comprise components for transferring heat with the air inside the structure 12. In the illustrated structure, a ducted indoor unit 16 and ductless indoor units 18 provide heating and cooling to various indoor spaces 20.

Focusing on the ducted indoor unit 16, it has an air-handler unit (or AHU) 24 that provides airflow circulation, which in the illustrated embodiment draws ambient indoor air via a return vent 26, passes that air over one or more heating/cooling elements (i.e., sources of heating or cooling), and then routes that conditioned air, whether heated or cooled, back to the various climate-controlled spaces 20 through supply vents 28. As depicted in FIG. 1, air between the AHU 24 (which may also be referred to as an air handler) and the vents 26 and 28 is carried by ducts or ductwork 30, which are relatively large pipes that may be rigid or flexible. A blower 32 provides the motivational force to generate airflow and circulate the ambient air through the vents 26 and 28, AHU 24, and ducts 30.

As shown, the ducted indoor unit 16 is a "dual-fuel" system that has multiple heating elements. A gas furnace 34, which may be located downstream (in terms of airflow) of the blower 32, combusts natural gas to produce heat in furnace tubes (not shown) that coil through the furnace.

These furnace tubes act as a heating element for the ambient indoor air being pushed out of the blower 32, over the furnace tubes, and into supply ducts 30 to supply vents 28. In other instances, the furnace 34 is an electric furnace, with one or more heat strips or other electric heating elements for heating air passing through the AHU 24, rather than a gas furnace. Whether gas or electric, the furnace 34 is generally operated when robust heating is desired. During conventional heating and cooling operations, air from the blower 32 is routed over an indoor heat exchanger 36 and into the supply ducts 30.

The blower 32, furnace 34, and indoor heat exchanger 36 may be packaged as an integrated AHU, or those components may be modular. Moreover, it is envisaged that the positions of the furnace, indoor heat exchanger, and blower can be reversed or rearranged. Internal components of the blower 32, the furnace 34, and the indoor heat exchanger 36 can be positioned within one or more casings, cabinets, or other housings (integrated or modular).

The indoor heat exchanger 36—which in this embodiment for the ducted indoor unit 16 is an A-coil 38 (FIG. 2), as it known in the industry—can act as a heating or cooling element that adds or removes heat from the structure by manipulating the pressure and flow of refrigerant circulating within and between the A-coil 38 and the outdoor unit 14 via refrigerant lines 40.

In the illustrated embodiment of FIG. 1, the state of the A-coil 38 (i.e., absorbing or releasing heat) is the opposite of the outdoor heat exchanger 42. More specifically, if heating is desired, the illustrated indoor heat exchanger 36 acts as a condenser, aiding transition of the refrigerant from a high-pressure gas to a high-pressure liquid and releasing heat in the process. And the outdoor heat exchanger 42 acts as an evaporator, aiding transition of the refrigerant from a low-pressure liquid to a low-pressure gas, thereby absorbing heat from the outdoor environment. If cooling is desired, the outdoor unit 14 has flow-control devices 44 that reverse the flow of the refrigerant—such that the outdoor heat exchanger 42 acts as a condenser and the indoor heat exchanger 36 acts as an evaporator. The outdoor unit 14 also contains other equipment—like a compressor 46, which provides the motivation for circulating the refrigerant, and electrical control circuitry 48, which provides command and control signals to various components of the system 10.

The outdoor unit 14 is a side-flow unit that houses, within a plastic or metal casing or housing 50, the various components that manage the refrigerant's flow and pressure. This outdoor unit 14 is described as a side-flow unit because the airflow across the outdoor heat exchanger 42 is motivated by a fan that rotates about an axis that is non-perpendicular with respect to the ground. In contrast, "up-flow" devices generate airflow by rotating a fan about an axis generally perpendicular to the ground. (As illustrated, the Y-axis is perpendicular to the ground.) In one embodiment, the side-flow outdoor unit 14 may have a fan 52 that rotates about an axis that is generally parallel to the ground. (As illustrated, the X- and Z-axes are parallel to the ground.) It is envisaged that either up-flow or side-flow units could be employed. Advantageously, the side-flow outdoor unit 14 provides a smaller footprint than traditional up-flow units, which are more cubic in nature.

In addition to the ducted indoor unit 16, the illustrated HVAC system has ductless indoor units 18 that also circulate refrigerant, via the refrigerant lines 40, between the outdoor heat exchanger 42 and the ductless indoor unit's heat exchanger. The ductless indoor units 18 may work in conjunction with or independent of the ducted indoor unit 16 to heat or cool the given indoor space 20. That is, the given indoor space 20 may be heated or cooled with the structure's air that has been conditioned by the ductless indoor unit 18 and by the air routed through the ductwork 30 after being conditioned by the A-coil 38, or it may be entirely conditioned by the ductless indoor unit or the ducted indoor unit working independent of one another. As another embodiment, the A-coil refrigerant loop may be operated to provide cooling or heating only—and the ductless indoor units may also be designed to provide cooling or heating only.

As is well known, the HVAC system may be in communication with a thermostat 54 that senses the indoor space's temperature and allows the structure occupants to "set" the desired temperature for that sensed indoor space. The thermostat may operate using a simple on/off protocol that sends 24V signals, for example, to the HVAC system to either activate or deactivate various components; or it may be a more complex thermostat that uses a "communicating protocol," such as ClimateTalk or P1/P2, that sends and receives data signals and can provide more complex operating instructions to the HVAC system.

Figure 2:
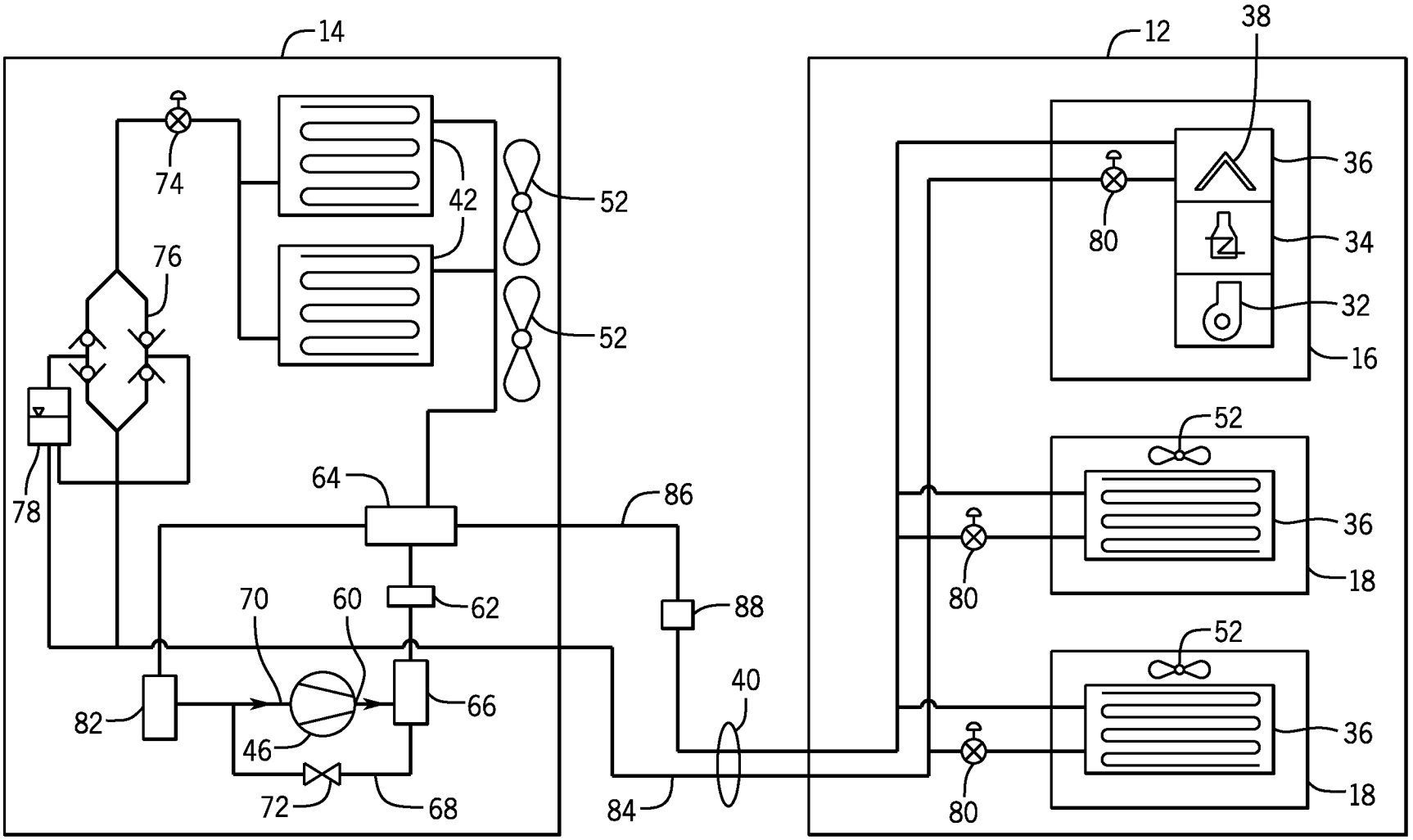
FIG. 2 is a schematic process-and-instrumentation drawing of an HVAC system for heating and cooling indoor spaces within a structure, in accordance with one embodiment.

FIG. 2 provides further detail about the various components of an HVAC system and their operation. The compressor 46 draws in gaseous refrigerant and pressurizes it, sending it into the closed refrigerant loop 40 via compressor outlet 60. (A flow meter 62 may be used to measure the flow of refrigerant out of the compressor.) The outlet 60 is connected to a reversing valve 64, which may be electronic, hydraulic, or pneumatic and which controls the routing of the high-pressure gas to the indoor or outdoor heat exchangers. Moreover, the outlet 60 may be coupled to an oil separator 66 that isolates oil expelled by the compressor and, via a return line 68, returns the separated oil to the compressor inlet 70—to help prevent that expelled oil from reaching the downstream components and helping ensure the compressor maintains sufficient lubrication for operation. The oil return line 68 may include a valve 72 that reduces the pressure of the oil returning to the compressor 46.

To cool the structure, the high-pressure gas is routed to the outdoor heat exchangers 42, where airflow generated by the fans 52 aids the transfer of heat from the refrigerant to the environment—causing the refrigerant to condense into a liquid that is at high-pressure. As shown, the outdoor unit 14 has multiple heat exchangers 42 and fans 52 connected in parallel, to aid the HVAC system's operation.

The refrigerant leaving the heat exchangers 42 is or is almost entirely in the liquid state and flows through or bypasses a metering device 74. From there, the high-pressure liquid refrigerant flows into a series of receiver check valves 76 that manage the flow of refrigerant into the receiver 78. The receiver 78 stores refrigerant for use by the system and provides a location where residual high-pressure gaseous refrigerant can transition into liquid form. The receiver may be located within the casing 50 of the outdoor unit or may be external to the casing 50 of the outdoor unit (or the system may have no receiver at all). From the receiver 78, the high-pressure liquid refrigerant flows to the indoor units 16, 18, specifically to metering devices 80 that restrict the flow of refrigerant into each heat exchanger of the indoor units 16, 18, to reduce the refrigerant's pressure. The refrigerant leaves the indoor metering devices 80 as a low-pressure liquid (or mostly liquid). In the described embodiment, the metering device 80 is an electronic expansion valve, but other types of metering devices—like capillaries, thermal expansion valves, reduced orifice tubing—are also envisaged. Electronic expansion valves provide precise control of refrigerant flow into the heat exchangers of the indoor units, thus allowing the indoor units—in conjunction with the compressor—to provide individualized cooling for the given indoor space 20 the unit is assigned to.

Low-pressure liquid refrigerant is then routed to the indoor heat exchangers 36. As illustrated, the indoor heat exchanger 36 for the ducted indoor unit 16 is an "A-coil" style heat exchanger 38. But the heat exchanger 38 can be an "N-coil" (or "Z-coil") style heat exchanger or a slab coil or can take any other suitable form. Airflow generated by the blower 32 aids in the absorption of heat from the flowing air by the refrigerant, causing the refrigerant to transition from a low-pressure liquid to a low-pressure gas as it progresses through the indoor heat exchanger 36. And the airflow generated by the blower 32 drives the now cooled air into the ductwork 30 (specifically the supply ducts), cooling the indoor spaces 20. In a similar fashion, the low-pressure liquid refrigerant is routed to the indoor heat exchangers 36 of the ductless indoor units 18, where it is evaporated, causing the refrigerant to absorb heat from the environment. However, unlike the ducted indoor unit, the ductless indoor units circulate air without ductwork, using a local fan 52, for example.

The refrigerant leaving the indoor heat exchangers 36, which is now entirely or mostly a low-pressure gas, is routed to the reversing valve 64 that directs refrigerant to the accumulator 82. Any remaining liquid in the refrigerant is separated in the accumulator, ensuring that the refrigerant reaching the compressor inlet 70 is almost entirely in a gaseous state. The compressor 46 then repeats the cycle, by compressing the refrigerant and expelling it as a high-pressure gas.

For heating the structure 12, the process is reversed. High-pressure gas is still expelled from the compressor outlet 60 and through the oil separator 66 and flow meter 62. However, for heating, the reversing valve 64 directs the high-pressure gas to the indoor heat exchangers 36. There, the refrigerant—aided by airflow from the blower 32 or the fans 52—transitions from a high-pressure gas to a high-pressure liquid, rejecting heat. And that heat is driven by the airflow from the blower 32 into the ductwork 30 or by the fans 52 in the ductless indoor units 18, heating the indoor spaces 20. If more robust heating is desired, the gas furnace 34 may be ignited, either supplementing or replacing the heat from the heat exchanger. That generated heat is driven into the indoor spaces by the airflow produced by the blower 32. In other instances, electric heating elements (e.g., of an electric furnace 34 of the indoor units 16 or 18) may also or instead be used to provide heat to the indoor spaces 20.

The high-pressure liquid refrigerant leaving each indoor heat exchanger 36 is routed through or past the given metering valve 80, which is, in this embodiment, an electronic expansion valve. But for other embodiments, the valve may be any other type of suitable expansion valve, like a thermal expansion valve or capillary tubes, for example. Using the refrigerant lines 40, the high-pressure liquid refrigerant is routed to the receiver check valves 76 and into the receiver 78. As described above, the receiver 78 stores liquid refrigerant and allows any refrigerant that may remain in gaseous form to condense. From the receiver, the high-pressure liquid refrigerant is routed to an outdoor metering device 74, which lowers the pressure of the liquid. Just like the indoor metering device 80, the illustrated outdoor metering device 74 is an electrical expansion valve. But it is envisaged that the outdoor metering device could be any number of devices, including capillaries, thermal expansion valves, reduced orifice tubing, for example.

The lower-pressure liquid refrigerant is then routed to the outdoor heat exchangers 42, which are acting as evaporators. That is, the airflow generated by the fans 52 aids the transition of low-pressure liquid refrigerant to a low-pressure gaseous refrigerant, absorbing heat from the outdoor environment in the process. The low-pressure gaseous refrigerant exits the outdoor heat exchanger 42 and is routed to the reversing valve 64, which directs the refrigerant to the accumulator 82. The compressor 46 then draws in gaseous refrigerant from accumulator 82, compresses it, and then expels it via the outlet 60 as high-pressure gas, for the cycle to be repeated.

As illustrated in FIG. 2, the system is a "two-pipe" variable refrigerant flow system, in which the HVAC system's refrigerant is circulated between the outdoor and indoor units via two refrigerant lines 40, one of which is a line that carries predominantly liquid refrigerant (a liquid line 84) and one of which is a line that carries predominately gas refrigerant (a gas line 86). However, it is also envisaged that, in other embodiments, aspects described herein could be applied to a three-pipe variable refrigerant flow system, in which in addition to the gas and liquid lines a third discharge line aids in the circulation of refrigerant.

In many instances, the structure 12 may have had a previous HVAC system with pre-existing refrigerant piping at least partially built into the structure's interior walls. For example, the pre-existing system may be a traditional HVAC unit that uses circulating refrigerant for cooling only and a gas furnace for heating, with all of the conditioned air delivered to the interior spaces via the ductwork. And the pre-existing refrigerant lines—which are built into the walls of the structure—may have a gas line with a ⅝-inch, ⅞-inch, or ⅜-inch outer diameter gas line. However, in certain embodiments, the outdoor unit 14 may have more modern refrigerant piping, which tends to be smaller in outer diameter. For example, the outdoor unit 14 may be 2-, 3-, or 4-Ton unit that has a gas line diameter of ⅝ inch. It would be laborious and cost ineffective to replace the pre-existing gas line in the structure with ⅝-inch diameter tubing. Accordingly, the illustrated HVAC system includes a coupler 88 that helps couple the varying diameter gas lines to one another. For example, the coupler 88 may facilitate coupling of the outdoor unit's ⅝-inch diameter gas line to the structure's pre-existing ⅝-inch, ⅞-inch, or ⅜-inch diameter gas line. In another embodiment, the outdoor unit 14 may be a 5-Ton unit with a gas line having a diameter of ⅝ inch. The coupler could facilitate coupling of this outdoor unit with a pre-existing gas line of ⅞-inch or ⅜-inch diameter.

Figure 3:
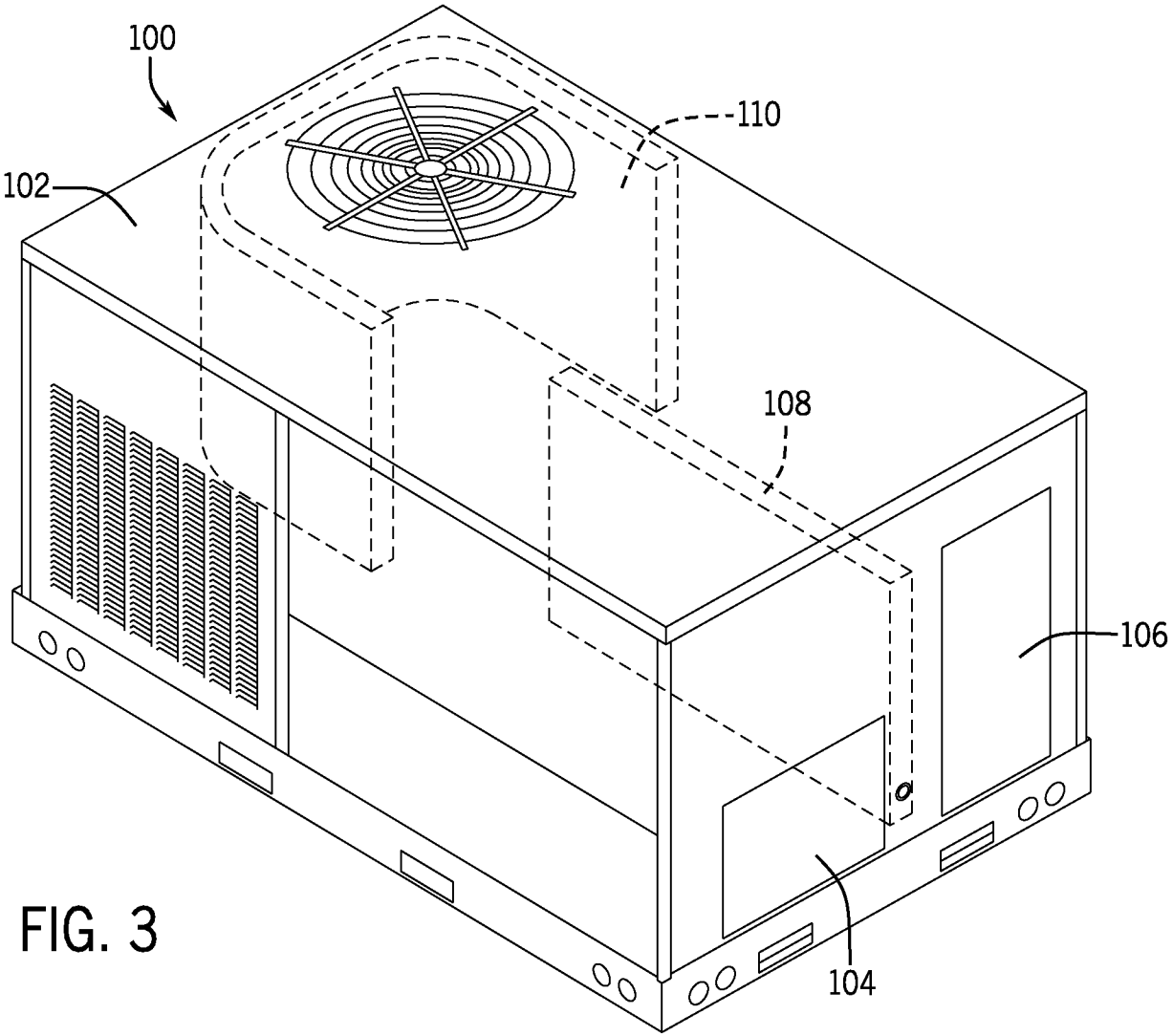
FIG. 3 generally depicts a packaged HVAC system having heat exchangers and other components in a shared cabinet in accordance with one embodiment.

In another embodiment depicted in FIG. 3, a packaged HVAC system 100 includes various components housed in a shared cabinet 102. The packaged system 100 can output conditioned air (e.g., heated or cooled air) from a supply duct opening 104 and draw air into the cabinet 102 via a return duct opening 106. Ductwork can be connected between a structure and the openings 104 and 106 to circulate air between the system 100 and the structure. Heat exchangers 108 and 110 within the cabinet 102 facilitate heat transfer and allow ambient air received through the return duct opening 106 to be treated (e.g., heated or cooled) and supplied to the structure via the supply duct opening 104. The heat exchanger 108 is an evaporator coil and the heat exchanger 110 is a condenser coil in at least some instances. Like described above with respect to the split system 10, fluid refrigerant is circulated through and between the heat exchangers 108 and 110 to cause the refrigerant to cycle between the liquid and gas phases and transfer heat with ambient air. It will be appreciated that other components are also installed within the cabinet 102, such as a blower, a compressor, and tubing for routing the refrigerant between the compressor and the heat exchangers 108 and 110.

The heat exchangers 36, 42, 108, and 110 can be provided in any suitable form. In certain embodiments, for instance, some or all of the heat exchangers 36, 42, 108 and 110 are microchannel heat exchangers. An example of a microchannel heat exchanger 120 is generally provided in FIG. 4. In this depicted example, the microchannel heat exchanger 120 includes an array 122 of tubes arranged between manifolds 124 and 126. Refrigerant is conveyed between the manifolds 124 and 126 by the tube array 122. More specifically, at least some tubes of the array 122 connect the manifold 124 in fluid communication with the manifold 126.

Figure 4:
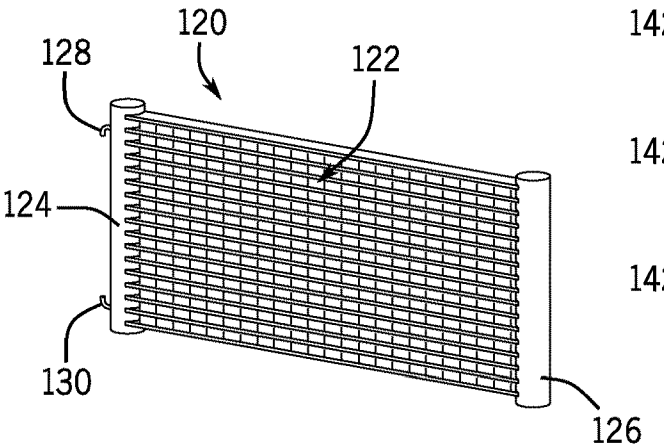
FIG. 4 generally depicts a microchannel heat exchanger having an array of tubes between two manifolds in accordance with one embodiment.

In the embodiment depicted in FIG. 4, the microchannel heat exchanger 120 is a closed refrigerant circuit including connections 128 and 130 for receiving refrigerant and then outputting refrigerant after passing through tubes of the array 122. The connection 128 is an inlet and the connection 130 is an outlet in some embodiments, but this is reversed in others, with the connection 130 as the inlet and the connection 128 as the outlet. As shown, the microchannel heat exchanger 120 is a multi-pass heat exchanger in which refrigerant passes from the manifold 124 to the manifold 126 and is then returned from the manifold 126 to the manifold 124. That is, refrigerant received through the inlet (e.g., connection 128) passes from the manifold 124 to the manifold 126 through some of the tubes of the array 122. This refrigerant is then returned from the manifold 126 to the manifold 124 through other tubes of the array 122.

The microchannel heat exchanger 120 can have any suitable number of passes in which refrigerant flows from one of the manifolds 124 or 126 to the other. For instance, the microchannel heat exchanger 120 can be a two-pass heat exchanger in which the refrigerant received in the manifold 124 via the inlet flows in one direction (a first pass) from the manifold 124 to the manifold 126 through some of the tubes of the array 122 and then flows in an opposite direction (a second pass) from the manifold 126 to the manifold 124 through other tubes of the array 122 before exiting the heat exchanger 120 through the outlet. In other embodiments, the heat exchanger 120 with the inlet and outlet provided on the manifold 124 could have four, six, eight, ten, or even more passes. In still other instances, the inlet and outlet could be provided on opposite sides (e.g., the inlet on the manifold 124 and the outlet on the manifold 126) and the heat exchanger 120 may have an odd number of passes, such as one pass, three passes, five passes, seven passes, nine passes, and so forth.

Figure 5:
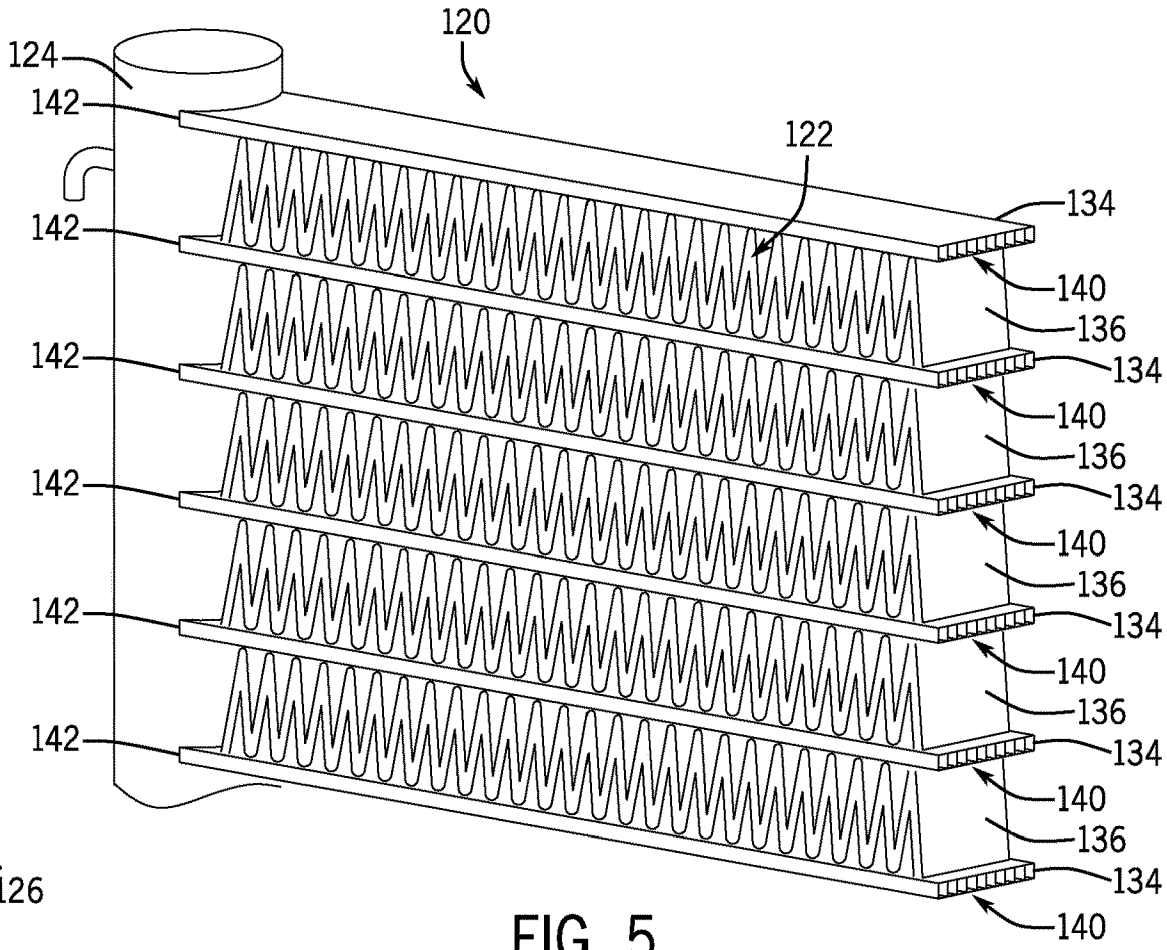
FIG. 5 is a detail view of a portion of the heat exchanger of FIG. 4 and shows flat tubes of the heat exchanger having microchannels for conveying refrigerant between the two manifolds in accordance with one embodiment.

Additional details of the microchannel heat exchanger 120 are depicted in FIG. 5. In this example, the array 122 includes tubes 134 with heat transfer fins 136. The tubes 134 include microchannels 140 for conveying refrigerant between the manifolds 124 and 126. Opposite ends 142 of at least some tubes 134 of the array 122 are connected to the manifolds 124 and 126 to enable refrigerant to flow between the manifolds 124 and 126 via those tubes 134. As described in greater detail below, however, in at least some embodiments one or more other tubes 134 of the array 122 do not connect the manifolds 124 and 126 in fluid communication with each other and do not convey refrigerant between the manifolds 124 and 126. The tubes 134 that are connected to convey refrigerant between the manifolds 124 and 126 may be considered live tubes, while the tubes 134 that are not connected to convey refrigerant between the manifolds 124 and 126 may be considered dead tubes.

Each tube 134 is shown in FIG. 5 as having ten microchannels 140, but the tubes 134 may have some other number of microchannels 140. In certain other embodiments, the heat exchanger 120 is not a microchannel heat exchanger and the tubes 134 do not include microchannels 140. And while the tubes 134 are shown in FIG. 5 as flat tubes, in other embodiments the tubes 134 could have some other shape, such as round tubes.

Ambient air is treated by flowing the ambient air through the array 122, between the tubes 134 and past the fins 136, and transferring heat between the refrigerant circulated through the tubes 134 and the ambient air. Although the heat exchanger 120 is depicted in FIG. 5 as having triangular fins 136, these fins 136 can take various other shapes and forms. In some embodiments, for instance, the fins 136 can also or instead include plain fins, wavy fins, perforated pins, louvered fins, serrated fins, rectangular fins, or curved fins.

The heat exchanger 120 can be made of any suitable material. In some embodiments, the heat exchanger 120 is an aluminum heat exchanger having each of the manifolds 124 and 126, the tubes 134, and the fins 136 made of aluminum or an aluminum alloy. Each of the components could be made of the same aluminum alloy, for instance, or multiple aluminum materials (pure aluminum or aluminum alloys) could be used for the different components. Other materials, such as stainless steel, copper, or polymer, may also or instead be used.

Figure 6:
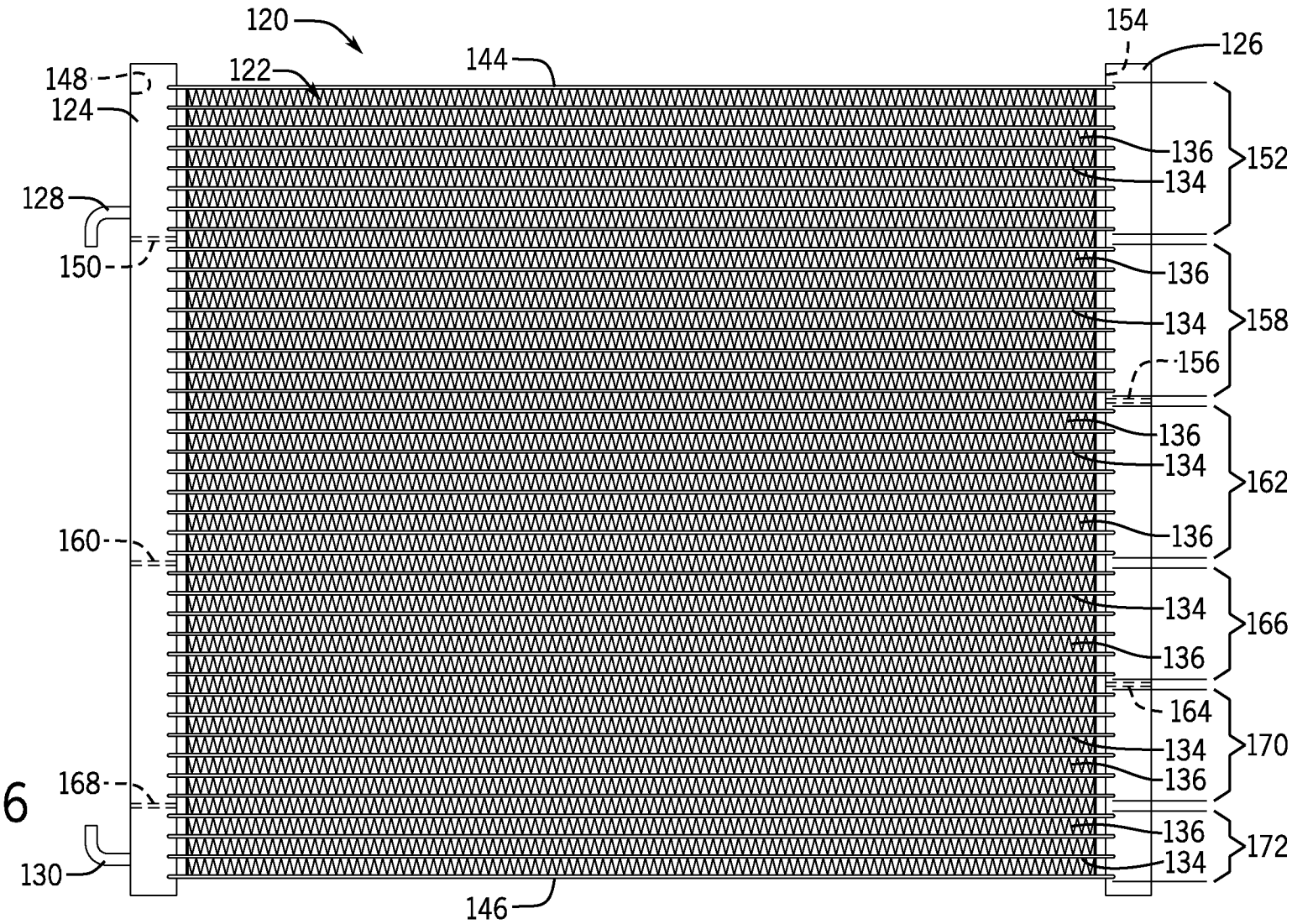
FIG. 6 is an elevational view of a microchannel heat exchanger like that of FIG. 4 and shows an array of flat microchannel tubes arranged between two manifolds and baffles in the manifolds to control flow through the heat exchanger in accordance with one embodiment.

By way of further example, the heat exchanger 120 is shown as a six-pass microchannel heat exchanger in FIG. 6. As depicted, the heat exchanger 120 includes an array 122 of flat tubes 134, which include an outer flat tube 144 at the upper end of the array 122, an outer flat tube 146 at the lower end of the array 122, and additional flat tubes 134 (inner flat tubes) positioned between the outer tubes 144 and 146. The tubes 134 (including the inner tubes, the outer tube 144, and the outer tube 146) can be arranged in parallel within the array 122. Although shown in the shape of a slab coil in FIG. 6, the heat exchanger 120 may be constructed in any other suitable shape, such as an A-shape or a C-shape.

Refrigerant may be received through the connection 128 into a bore 148 of the manifold 124. A baffle 150 (e.g., a separator plate) within the bore 148 blocks flow of the refrigerant down the bore 148 and causes the refrigerant received through the connection 128 to flow from the manifold 124 through a first subset 152 of tubes 134 (which includes the outer flat tube 144) into a bore 154 of the manifold 126. This transit of refrigerant from the manifold 124 to the manifold 126 through the first subset 152 of tubes 134 is the first pass in the heat exchanger 120. A baffle 156 in the bore 154 causes the refrigerant received from the first subset 152 of tubes 134 to then flow through a second subset 158 of tubes 134 from the manifold 126 to the manifold 124 (i.e., the second pass). In similar fashion, a baffle 160 causes this refrigerant to flow back to the manifold 126 through a third subset 162 of the tubes 134 (i.e., the third pass), and a baffle 164 then causes the refrigerant to flow from the manifold 126 back to the manifold 124 though a fourth subset 166 of tubes 134 (i.e., the fourth pass). Another baffle 168 causes refrigerant received in the manifold 124 from the fourth subset 166 of tubes 134 to flow to the manifold 126 through a fifth subset 170 of tubes 134 (i.e., the fifth pass), and the refrigerant flows back to the manifold 124 from the manifold 126 through a sixth subset 172 of tubes 134 (i.e., the sixth pass) and exits the heat exchanger 120 through the connection 130.

Because they control flow through the manifolds and direct refrigerant into tubes 134, the baffles 150, 156, 160, 164, and 168 may be said to divide the passes through the heat exchanger 120. That is, the baffle 150 divides the first pass from the second pass, the baffle 156 divides the second pass from the third pass, the baffle 160 divides the third pass from the fourth pass, the baffle 164 divides the fourth pass from the fifth pass, and the baffle 168 divides the fifth pass from the sixth pass.

Each pass can use any suitable number of tubes 134. The number of passes and the number of tubes used in each pass may be selected to optimize heat transfer and pressure drop through the heat exchanger 120. In at least some instances, the first pass uses more tubes 134 than the last pass. As depicted in FIG. 6, the heat exchanger 120 is provided in a top in—bottom out arrangement, in which the connection 128 is the inlet, the connection 130 is the outlet, the first pass is at the top end of the array 122, each subsequent pass is below the previous pass, and the earlier passes (i.e., the first, second, and third passes) use more tubes 134 than the later passes (i.e., the fourth, fifth, and sixth passes). In other embodiments, the heat exchanger 120 may be provided in a bottom in—top out arrangement, in which the connection 130 is the inlet, the connection 128 is the outlet, the first pass is at the bottom end of the array 122, and each subsequent pass is above the previous pass. In such a bottom in—top out arrangement, the earlier passes may still use more tubes 134 than the later passes, but with the passes having more tubes located below those with fewer tubes. Baffles (e.g., baffles 150, 156, 160, 164, and 168) may be provided at any desired locations within the manifolds 124 and 126 to control flow of refrigerant through the heat exchanger 120, set the number of passes, and determine the number of tubes 134 used for each pass.

Figure 7:
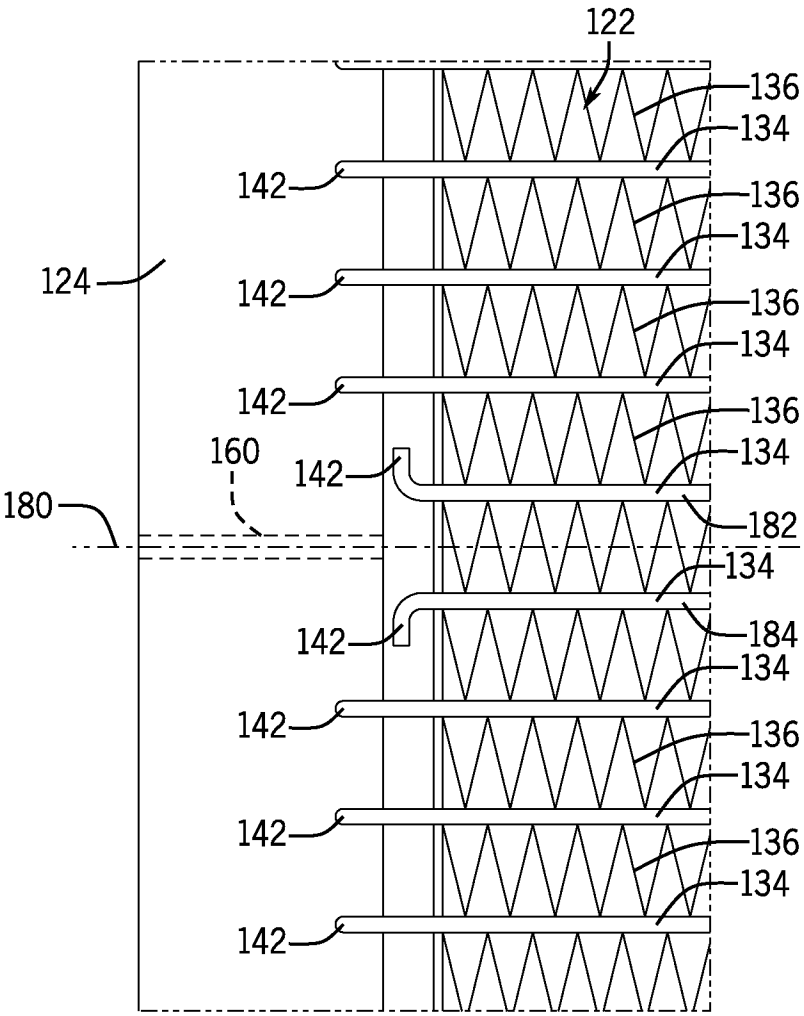
FIG. 7 is a detail view of the heat exchanger of FIG. 6 in which two tubes of the array of flat microchannel tubes are dead tubes that are positioned between refrigerant-carrying tubes, are not in fluid communication with a manifold, and are not used to convey refrigerant through the heat exchanger, in accordance with one embodiment.

While the tubes 134 of the array 122 collectively enable refrigerant to flow between the manifolds 124 and 126, one or more of the tubes 134 can be provided as dead tubes that do not convey refrigerant between the manifolds 124 and 126. In some embodiments, the array 122 includes dead tubes to reduce thermal cross-conduction between tubes of two different passes. As depicted in FIG. 7, for instance, the baffle 160 divides two adjacent passes, with one pass above line 180 conveying refrigerant between the manifolds 124 and 126 in one direction (e.g., from left to right) and another pass below line 180 conveying refrigerant between the manifolds 124 and 126 in an opposite direction (e.g., from right to left). The temperature of the refrigerant changes as it is routed through the heat exchanger 120, and the temperature of the refrigerant may differ significantly between these two passes. Rather than having the two passes directly adjacent one another (with live tubes 134 of one pass immediately followed in the array 122 by live tubes 134 of the next pass), in the example of FIG. 7 the two flat tubes 134 of the array 122 closest to line 180 (i.e., tubes 182 and 184) are provided as dead tubes that separate the two passes within the array 122 and do not convey refrigerant. That is, the dead tubes 182 and 184 are interposed directly between the two passes within the array 122. This increases the distance between the live tubes of the two passes and reduces thermal cross-conduction between the two passes, which may increase efficiency of the heat exchanger 120.

In some instances, dead tubes may also or instead be provided in the array 122 to reduce thermal stress along a manifold 124 or 126 of the heat exchanger. In FIG. 7, for example, a temperature difference between refrigerant on either side of the baffle 160 in the manifold 124 can cause thermal stress across and around the baffle 160. Having the dead tubes 182 and 184 physically unconnected with the manifold 124 may reduce the thermal stress on the microchannel tubes at that location.

As shown in FIG. 7, and in contrast to the live tubes, the dead tubes 182 and 184 have bent ends 142 that are not connected to the manifold 124. The opposite ends 142 of the dead tubes 182 and 184 can be similarly bent and not connected to the manifold 126. But any other suitable technique may be used to prevent flow through dead tubes between manifolds 124 and 126. The dead tubes, for instance, may be shortened or crimped (e.g., at ends 142), plugged, or otherwise sealed to prevent refrigerant flow between the manifolds. And while the bent ends 142 of the dead tubes may be spaced apart from the manifolds 124 and 126, in other instances the ends 142 of the dead tubes may be physically connected to the manifolds 124 and 126 while still blocking flow of refrigerant through the dead tubes.

Figure 8:
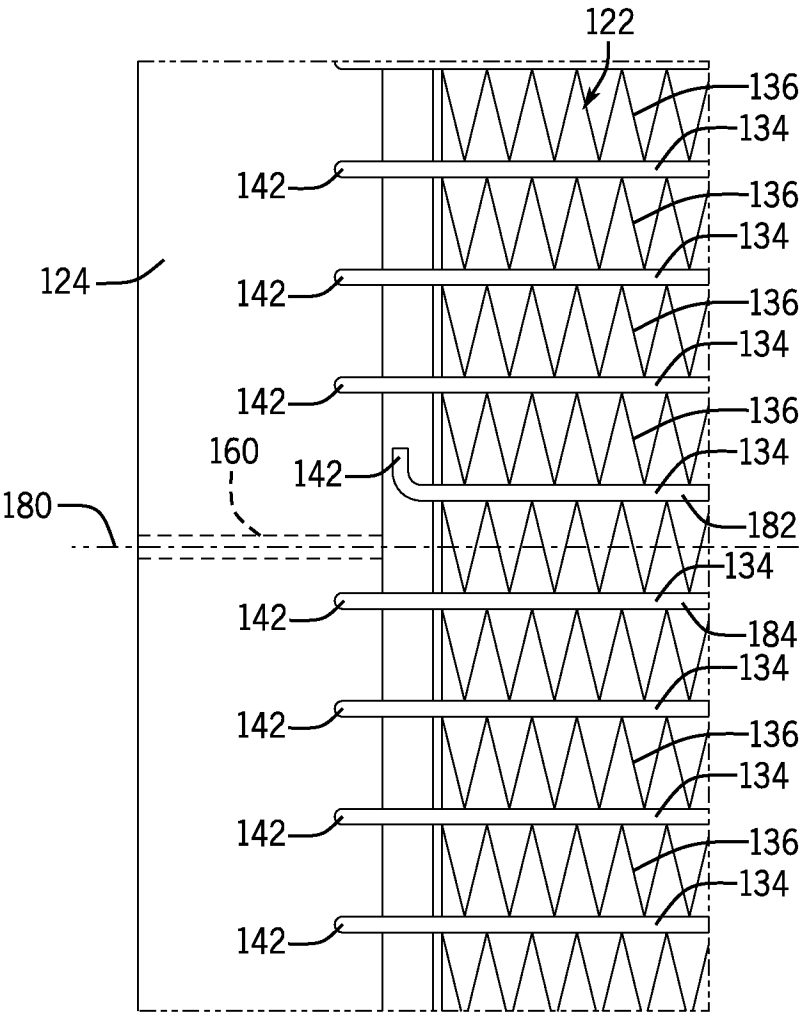
FIG. 8 is a detail view like that of FIG. 7 but showing just one tube as a dead tube positioned between refrigerant-carrying tubes of the array in accordance with one embodiment.

Although two dead tubes are depicted in FIG. 7, any suitable number of dead tubes may be provided to reduce thermal cross-conduction between two adjacent passes or to reduce thermal stress on these tubes along the manifold 124 or 126. In FIG. 8, for example, the tube 184 is instead a live tube (of the pass below the line 180) and a single dead tube (i.e., tube 182) separates the two adjacent passes. In other instances, three or more dead tubes may be used to separate two adjacent passes within the array 122.

Figure 9:
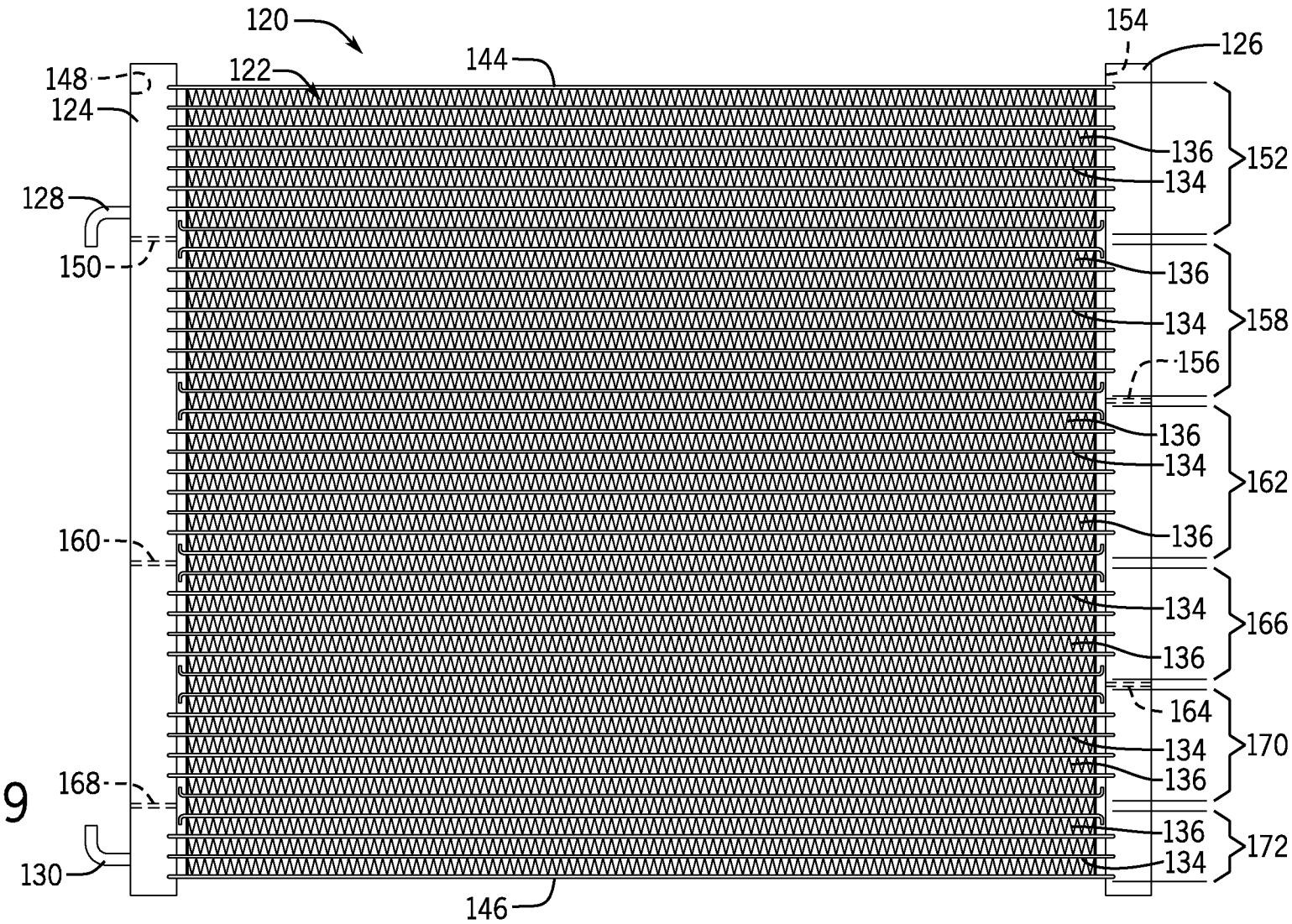
FIG. 9 is an elevational view of the heat exchanger of FIG. 6 with dead tubes provided between passes through the heat exchanger to reduce thermal cross-conduction between the passes in accordance with one embodiment.

In some embodiments, the microchannel heat exchanger 120 has at least one dead tube between each pair of adjacent passes. For instance, as depicted in FIG. 9, the microchannel heat exchanger 120 includes two dead tubes along each boundary between adjacent passes. In other examples, the array 122 may have some other number of dead tubes along each boundary between adjacent passes. And the number of dead tubes between adjacent passes may differ within the same array 122 (e.g., one dead tube provided between some passes and two dead tubes provided between other passes). In the case of the microchannel heat exchanger operating as a condenser, the dead tubes separating the first de-superheating pass from the second refrigerant pass are the most effective, since the temperature difference between the refrigerant flowing through the first pass and the second pass is the highest. Separating the last subcooling pass in the case of the microchannel condenser and the last superheating pass in the case of the microchannel evaporator by utilizing the dead tubes may also have a positive effect on the heat exchanger reliability, especially at high superheat and subcooling values.

Figure 10:
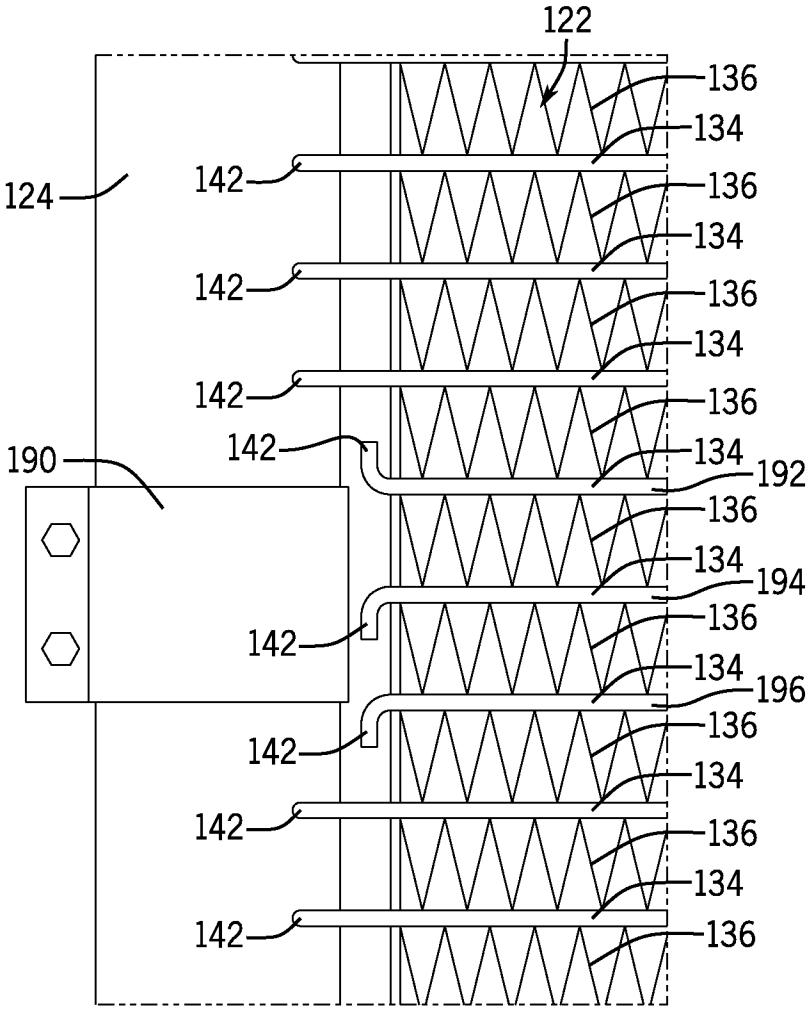
FIG. 10 is a detail view of a heat exchanger portion in which dead tubes are provided in the tubular array to reduce thermal stress along a manifold in accordance with one embodiment.

Although dead tubes can be provided in the array 122 to reduce thermal stress near a baffle, as discussed above, dead tubes may also or instead be provided in the array 122 to reduce thermal stress at other locations. In FIG. 10, for example, a clamp or mounting bracket 190 is attached to the manifold 124. The array 122 includes flat tubes 134, some of which are live tubes connected in fluid communication to the manifold 124 to convey refrigerant between the manifold 124 and manifold 126. But several other flat tubes 134 (i.e., tubes 192, 194, and 196) are provided as dead tubes near the bracket 190, which may reduce a temperature gradient induced stress along the manifold 124 at the bracket 190 location for the otherwise live tubes. Although three dead tubes are depicted near the bracket 190 in FIG. 10, some other number of dead tubes may be used in other instances.

Still further, dead tubes may also or instead be provided in the array 122 of the heat exchanger 120 to reduce corrosion and increase reliability. Heat exchangers, such as microchannel heat exchangers, may be used in indoor or outdoor environments as evaporator or condenser coils. The heat exchangers may be subject to corrosion (e.g., galvanic or general corrosion) in the presence of standing water or debris accumulated in a base pan of an HVAC system or of drain pan water, water bridging, or splashing near the bottom of the heat exchanger. Corrosion of the heat exchanger can cause refrigerant leaks and negatively impact operating life. Sacrificial materials may be provided to protect the heat exchanger, such as zinc coating on the tubes or other components. In some instances, a heat exchanger is raised above a base pan or drip pan with stand-offs (e.g., rubber stand-offs) or a sheet metal emboss. But in some embodiments, dead tubes of the array 122 may be used as sacrificial tubes to increase the distance between a lowermost live tube of the array 122 and the pan below and reduce the incidence of corrosion of the refrigerant-carrying components of the heat exchanger.

Figure 11:
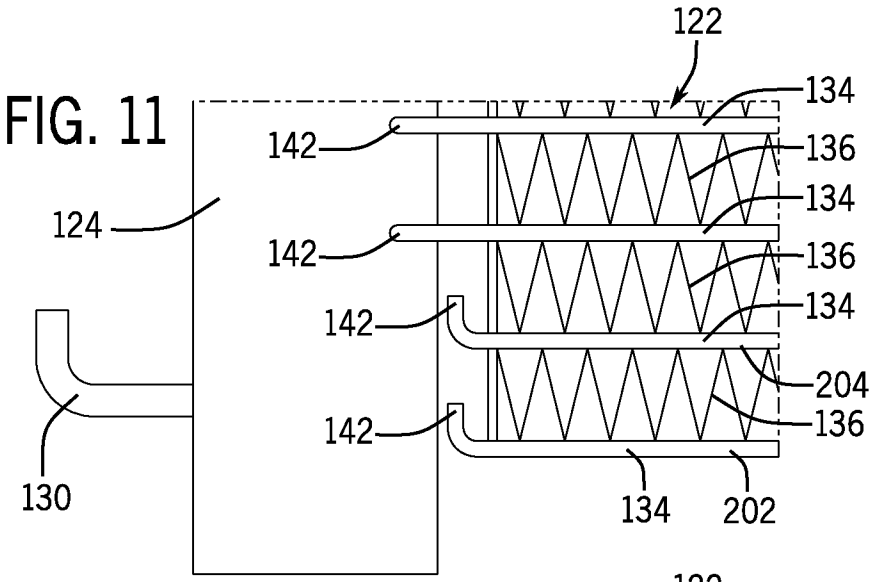
FIG. 11 is a detail view of a heat exchanger portion in which dead tubes are provided along a lower end of the tubular array to reduce corrosion of refrigerant-carrying tubes in accordance with one embodiment.
Figure 12:
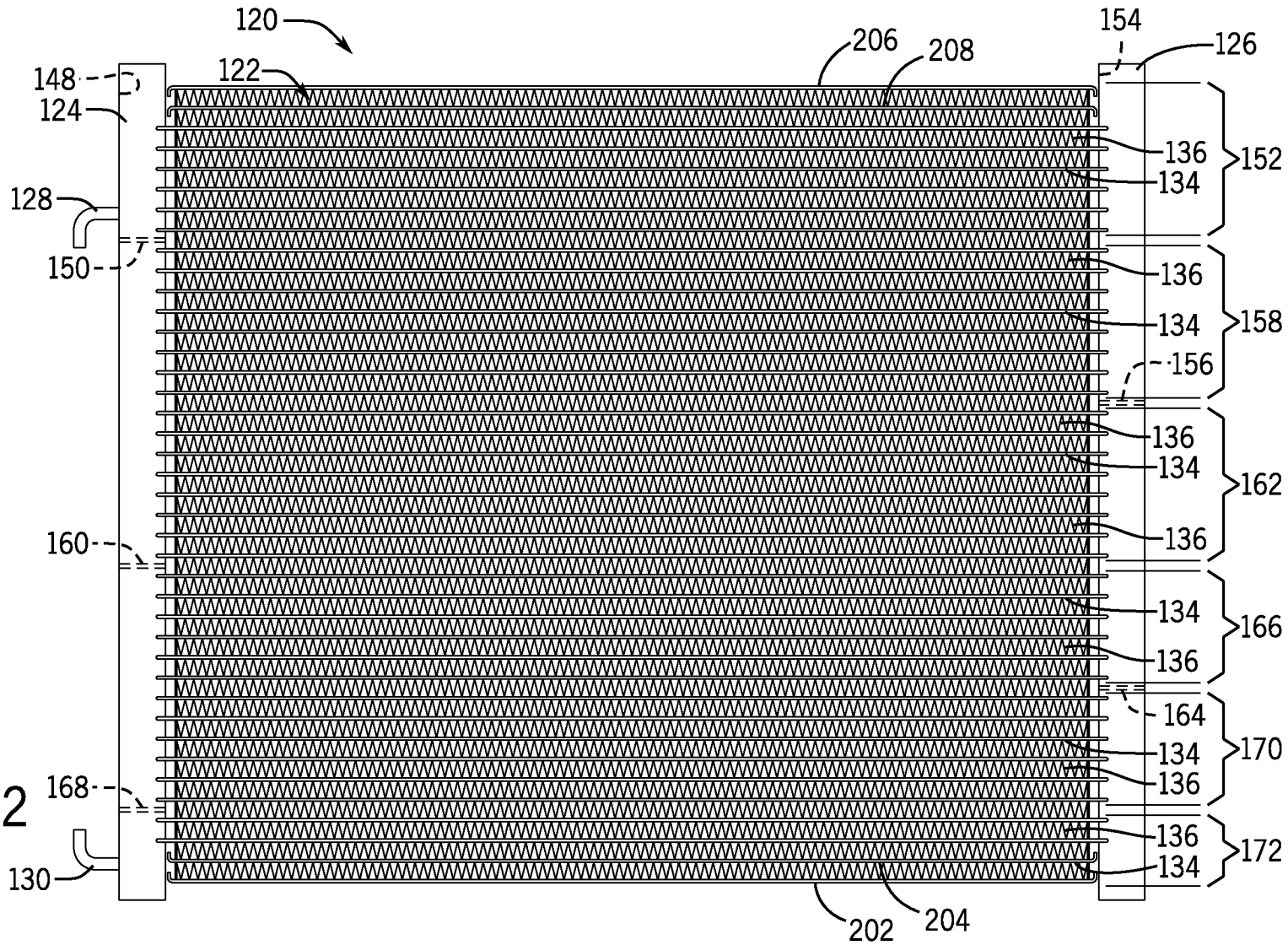
FIG. 12 is an elevational view of the heat exchanger of FIG. 6 depicting dead tubes along the upper and lower ends of the tubular array in accordance with one embodiment.

In FIGS. 11 and 12, for example, tubes 202 and 204 are the lowermost tubes 134 of the array 122 and are provided as dead tubes that do not convey refrigerant. When installed above a base pan in an HVAC system, the provision of tubes 202 and 204 as dead tubes increases the distance between the bottom of the base pan (where water or debris may accumulate) and the live tubes of the array 122 (e.g., the tubes 134 above tube 204 in FIG. 11), which may reduce corrosion and increase longevity of the heat exchanger 120. In some instances, the uppermost tubes 134 of the array 122 (e.g., tubes 206 and 208 in FIG. 12) may also or instead be provided as dead tubes. Although two dead tubes are shown at the top of the array 122 and at the bottom of the array 122 in FIG. 12, some other number of dead tubes may be provided at the top and bottom of the array 122 in other instances. The number of dead tubes provided at the top of the array 122 may also differ from the number of dead tubes provided at the bottom of the array 122.

Figure 14:
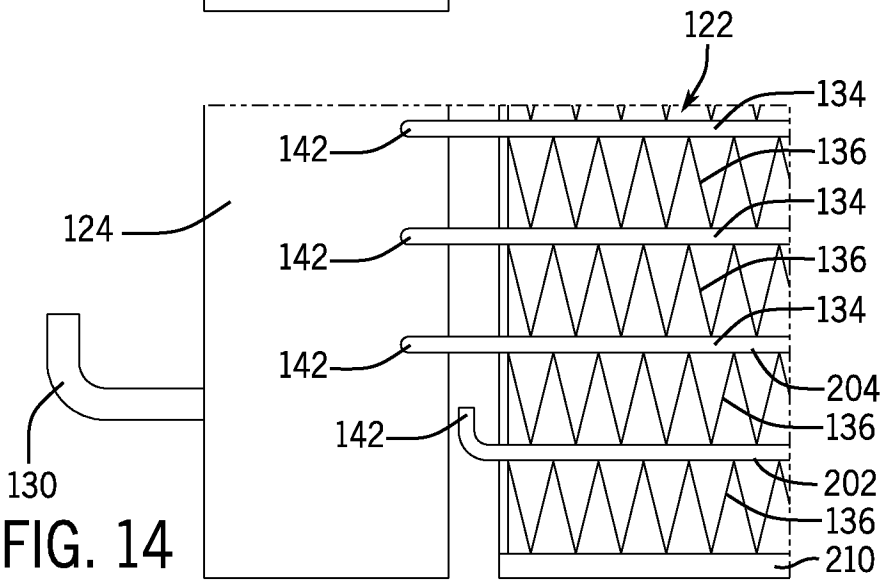
FIG. 14 is a detail view of a portion of the heat exchanger of FIG. 13 having a dead tube and protecting plate at a lower end of the heat exchanger in accordance with one embodiment.
Figure 13:
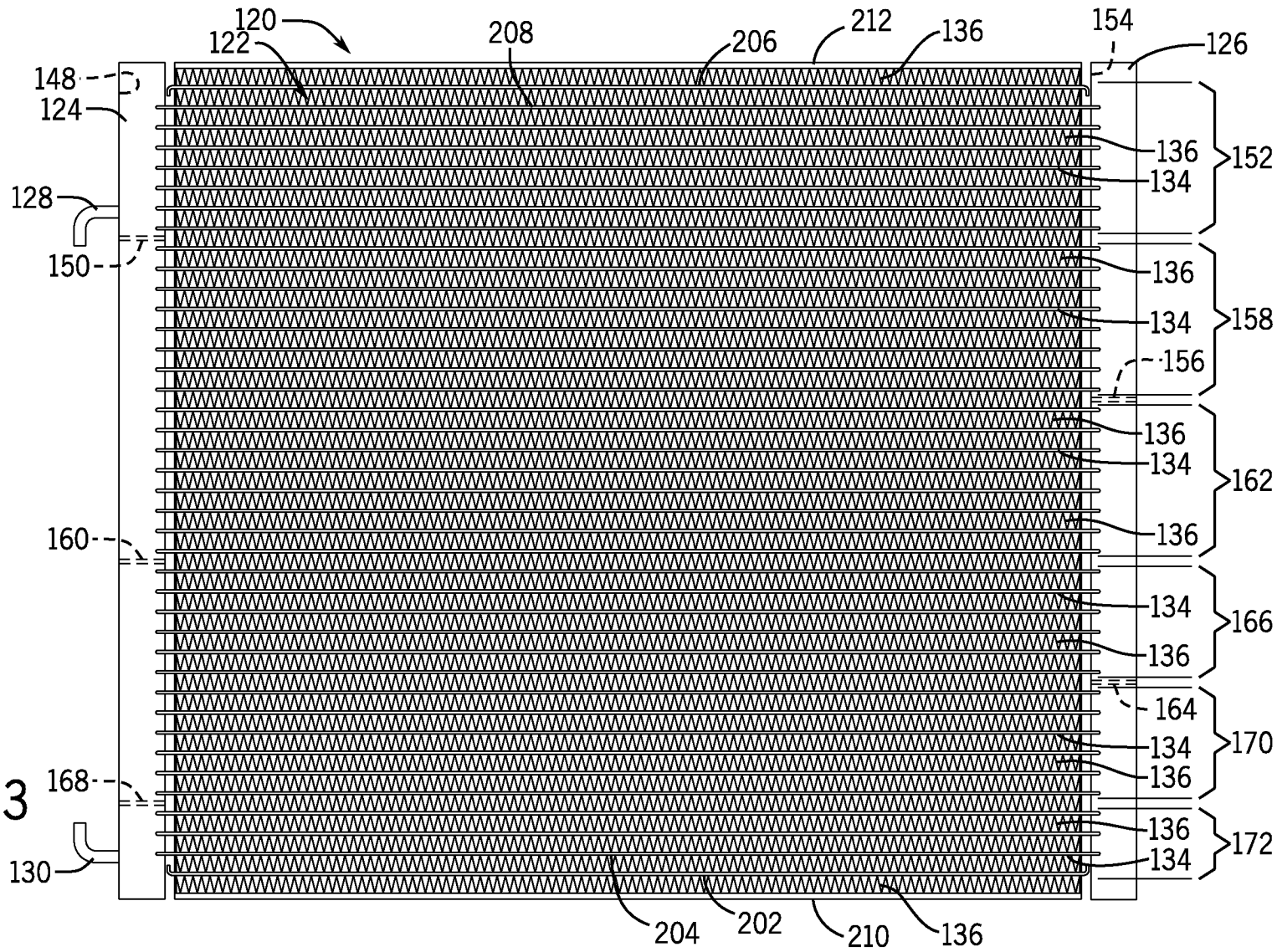
FIG. 13 is an elevational view of the heat exchanger of FIG. 6 with dead tubes provided as the outermost tubes of the tubular array and plates protecting the upper and lower ends of the tubular array in accordance with one embodiment.

In still other embodiments, plates are used to protect ends of the array 122. In an embodiment depicted in FIGS. 13 and 14, for instance, a lower plate 210 is positioned below the lowermost tube 202 and an upper plate 212 is positioned above the uppermost tube 206. The plates 210 and 212 provide mechanical protection to the upper and lower ends of the array 122 and may be made with a sacrificial material to reduce galvanic corrosion of the tubes 134 and manifolds 124 and 126. While only the outermost tubes (e.g., tubes 202 and 206) of the array 122 are depicted as dead tubes in FIG. 13, it will be understood that other tubes of the array 122, such as tubes 204 and 208, may also be provided as dead tubes.

Finally, the heat exchanger 120 can be constructed through any suitable manufacturing techniques. In some instances, this includes assembling the flat tubes 134 in the array 122 with the fins 136 and the manifolds 124 and 126 and then brazing the array 122 to the manifolds 124 and 126 and to the fins 136. Other components, such as protective plates 210 and 212, may also be brazed to the assembly. The brazing can be done with a non-corrosive flux in a vacuum furnace or other brazing oven, for example. In some embodiments, such as those with dead tubes having bent ends that do not contact the manifolds 124 and 126, brazing the array 122 to the manifolds 124 and 126 may include brazing live tubes of the array 122 to the manifolds 124 and 126 but not brazing dead tubes of the array 122 to the manifolds 124 and 126. The dead tubes may be brazed to the fins 136 or other components to mechanically secure the dead tubes in place within the array 122. In other instances, however, the dead tubes may also or instead be brazed to the manifolds 124 and 126 but prevented from conveying refrigerant between these manifolds in some other manner.

While the aspects of the present disclosure may be susceptible to various modifications and alternative forms, specific embodiments have been shown by way of example in the drawings and have been described in detail herein. But it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. An apparatus comprising:

a microchannel heat exchanger operable to exchange heat with air in an HVAC system via refrigerant passing through the microchannel heat exchanger, the microchannel heat exchanger including:

a first manifold;

a second manifold; and an array of flat tubes arranged between the first manifold and the second manifold, wherein the array of flat tubes includes multiple tubes coupled in fluid communication with the first manifold and the second manifold to convey refrigerant between the first manifold and the second manifold through microchannels of the multiple tubes, and the array of flat tubes also includes one or more dead tubes that do not convey refrigerant between the first manifold and the second manifold, and wherein each of the one or more dead tubes has ends that are physically unconnected to the first manifold and are physically unconnected to the second manifold, the microchannel heat exchanger is installed in the HVAC system with a bracket attached to the first or second manifold, and the one or more dead tubes include at least one dead tube that reduces thermal stress in the microchannel heat exchanger along the first or second manifold at the bracket.

2. The apparatus of claim 1, wherein the microchannel heat exchanger is a multi-pass microchannel heat exchanger configured such that, in operation, a first subset of flat tubes of the array of flat tubes conveys the refrigerant from the first manifold to the second manifold and a second subset of flat tubes of the array of flat tubes returns the refrigerant from the second manifold to the first manifold.

3. The apparatus of claim 2, wherein the one or more dead tubes includes at least one dead tube positioned between a first flat tube that conveys refrigerant from the first manifold to the second manifold and a second flat tube that conveys refrigerant from the second manifold to the first manifold such that the at least one dead tube reduces thermal cross-conduction between the first flat tube and the second flat tube.

4. The apparatus of claim 3, wherein the at least one dead tube is positioned at a location within the array such that the presence of the at least one dead tube at the location reduces thermal stress at the location compared to thermal stress that would be at the location if the at least one dead tube were instead a live tube.

5. The apparatus of claim 1, wherein the array of flat tubes includes a first outer flat tube that is at one end of the array, a second outer flat tube that is at an opposite end of the array, and a plurality of inner flat tubes located between, and in parallel with, the first outer flat tube and the second outer flat tube, wherein the plurality of inner flat tubes includes at least one dead tube of the one or more dead tubes.

6. The apparatus of claim 5, wherein the first outer flat tube is a dead tube of the one or more dead tubes.

7. The apparatus of claim 6, wherein an inner flat tube closest to the first outer flat tube within the array is an additional dead tube of the one or more dead tubes.

8. The apparatus of claim 7, wherein the second outer flat tube and an inner flat tube closest to the second outer flat tube within the array are additional dead tubes of the one or more dead tubes.

9. The apparatus of claim 1, comprising a baffle in the first manifold that divides a first pass of the microchannel heat exchanger from a second pass of the microchannel heat exchanger.

10. The apparatus of claim 9, wherein the first pass and the second pass are separated within the array of flat tubes by at least one dead tube of the one or more dead tubes.

11. The apparatus of claim 1, wherein the microchannel heat exchanger includes fins disposed in the array of flat tubes to facilitate heat exchange between the microchannel heat exchanger and the air.

12. The apparatus of claim 1, wherein the microchannel heat exchanger is installed in the HVAC system as a condenser.

13. The apparatus of claim 1, wherein the microchannel heat exchanger is installed in the HVAC system as an evaporator.

14. The apparatus of claim 1, wherein at least one dead tube of the one or more dead tubes separates two adjacent passes of the microchannel heat exchanger.

15. The apparatus of claim 14, wherein the microchannel heat exchanger is a condenser, and the two adjacent passes include a first de-superheating pass and a subsequent pass of the condenser.

16. The apparatus of claim 14, wherein the microchannel heat exchanger is a condenser, and one of the two adjacent passes is a last subcooling pass of the condenser.

17. The apparatus of claim 14, wherein the microchannel heat exchanger is an evaporator, and one of the two adjacent passes is a last superheating pass of the evaporator.

18. An HVAC system comprising:

a compressor;

a blower; and a microchannel heat exchanger operable to exchange heat with air in the HVAC system via refrigerant passing through the microchannel heat exchanger, wherein the microchannel heat exchanger includes an array of tubes arranged between a first manifold and a second manifold, the array of tubes includes live tubes coupled to the first manifold and the second manifold in a manner that allows refrigerant to pass between the first manifold and the second manifold via the live tubes, and the array of tubes includes one or more dead tubes that are not coupled to the first manifold and the second manifold in a manner that allows refrigerant to pass between the first manifold and the second manifold via the one or more dead tubes, and wherein each of the one or more dead tubes has ends that are physically unconnected to the first manifold and are physically unconnected to the second manifold, the microchannel heat exchanger includes a first connection for receiving refrigerant into the microchannel heat exchanger and a second connection for outputting refrigerant from the microchannel heat exchanger and is installed in the HVAC system with a bracket or other physical restraint that is attached to the first or second manifold and is independent of both the first connection and the second connection, and the one or more dead tubes include at least one dead tube that reduces thermal stress in the microchannel heat exchanger along the first or second manifold at the bracket or other physical restraint.

19. The HVAC system of claim 18, wherein the one or more dead tubes includes a dead tube that is neither the first tube nor the last tube of the array of tubes.

20. The HVAC system of claim 18, wherein the array of tubes includes an array of flat tubes.

21. The HVAC system of claim 18, wherein the HVAC system includes a packaged HVAC unit with the compressor, blower, and microchannel heat exchanger in a shared cabinet.

22. The HVAC system of claim 18, wherein the HVAC system includes a split system in which the compressor and blower are in separate cabinets.

23. A method comprising:

providing an array of flat microchannel tubes arranged between a first manifold and a second manifold of a microchannel heat exchanger operable to exchange heat with air in an HVAC system via refrigerant passing through the microchannel heat exchanger, wherein the microchannel heat exchanger includes the first manifold, the second manifold, and the array of flat microchannel tubes;

preventing fluid communication between the first manifold and the second manifold through one or more flat microchannel tubes of the array of flat microchannel tubes while permitting fluid communication between the first manifold and the second manifold through additional flat microchannel tubes of the array of flat microchannel tubes such that each of the one or more flat microchannel tubes does not convey refrigerant between the first manifold and the second manifold and has ends that are physically unconnected to the first manifold and are physically unconnected to the second manifold, and the additional flat microchannel tubes are coupled in fluid communication with the first manifold and the second manifold to convey refrigerant between the first manifold and the second manifold through microchannels of the additional flat microchannel tubes; and installing the microchannel heat exchanger in the HVAC system with a bracket attached to the first or second manifold such that at least one of the one or more flat microchannel tubes that do not convey refrigerant between the first manifold and the second manifold reduces thermal stress in the microchannel heat exchanger along the first of second manifold at the bracket.

24. The method of claim 23, comprising brazing the array of flat microchannel tubes to the first and second manifolds, wherein brazing the array of flat microchannel tubes includes brazing the additional flat microchannel tubes to the first and second manifolds but does not include brazing the one or more flat microchannel tubes to the first and second manifolds.

25. The method of claim 23, wherein preventing fluid communication between the first manifold and the second manifold through the one or more flat microchannel tubes includes bending the ends of the one or more flat microchannel tubes such that the one or more flat microchannel tubes do not meet the first and second manifolds.

26. The method of claim 23, wherein preventing fluid communication between the first manifold and the second manifold through the one or more flat microchannel tubes includes crimping an end of at least one flat microchannel tube of the one or more flat microchannel tubes to block flow through the at least one flat microchannel tube.

* * * * *